US005896790A

United States Patent [19]

Chiang

[11] Patent Number: 5,896,790

[45] Date of Patent: Apr. 27, 1999

[54] ADJUSTABLE WRENCH

[76] Inventor: Cho-Cheng Chiang, P.O. Box 63-247, Taichung, Taiwan

[21] Appl. No.: 09/014,201

[22] Filed: Jan. 28, 1998

[51] Int. Cl.[6] ..... B25B 13/28

[52] U.S. Cl. ..... 81/98; 81/111; 81/DIG. 3

[58] Field of Search ..... 81/98, 111, 113, 81/118, DIG. 3

[56] References Cited

U.S. PATENT DOCUMENTS

| | | | |
|---|---|---|---|
| 995,984 | 6/1911 | Pedery | 81/98 |
| 1,062,047 | 5/1913 | Smith | 81/111 |
| 1,367,407 | 2/1921 | McClurkin | 81/DIG. 3 X |
| 1,414,839 | 5/1922 | Stuarts | 81/DIG. 3 X |
| 1,763,828 | 6/1930 | Stewart | 81/111 |
| 2,407,990 | 9/1946 | Lurie | 81/118 |

*Primary Examiner*—James G. Smith
*Attorney, Agent, or Firm*—Charles E. Baxley, Esq.

[57] ABSTRACT

An adjustable wrench includes an elongated member including a first handle end and a second end. The second end includes a fixed jaw and an engaging section formed thereon. The fixed jaw has a first clamping section. A movable jaw has a second clamping section formed on a first end thereof and a second end pivotally connected to the engaging section of the elongated member. An adjusting device is mounted between the second end of the elongated member and the movable jaw to urge the movable jaw to pivot relative to the fixed jaw. A fine adjusting device is provided for actuating the adjusting device to urge the second clamping section of the movable jaw to move slightly away from the first clamping section of the fixed jaw. An elastic device is provided for retaining the adjusting device in position.

10 Claims, 5 Drawing Sheets

ADJUSTABLE WRENCH

BACKGROUND OF THE INVENTION

1. Field of the Invention

The present invention relates to an adjustable wrench having fine adjustment for clamping fasteners.

2. Description of the Related Art

A wire variety of wrenches, spanners, and pliers have heretofore been provided, and examples of which are U.S. Pat. Nos. 3,762,244 and 3,916,735 both to Evans; U.S. Pat. No. 5,551,322 to Mikic et al.; U.S. Pat. No. 5,630,344 to Nammoto; and U.S. Pat. No. 5,630,345 to Ciccotelli. Nevertheless, the jaws of the tools disclosed in these patents cannot provide an adequate clamping the fasteners between the jaws. Applicant's U.S. patent application Ser. No. 08/900,444 filed on Jul. 25, 1997 discloses an improved wrench which is aimed to solve the above problem. Nevertheless, the user still has to calculate the distance for clamping the fastener in order to speedily tighten or loosen the fastener. The present invention is intended to provide an improved design in this regard.

SUMMARY OF THE INVENTION

It is a primary object of the present invention to provide an adjustable wrench in which the user may speedily, tightly clamp the fastener without troublesome calculation of the distance required.

An adjustable wrench in accordance with the present invention includes an elongated member having a first handle end and a second end. The second end includes a fixed jaw and an engaging section formed thereon. The fixed jaw has a first clamping section. A movable jaw has a second clamping section formed on a first end thereof and a second end pivotally connected to the engaging section of the elongated member. An adjusting means is mounted between the second end of the elongated member and the movable jaw to urge the movable jaw to pivot relative to the fixed jaw. A fine adjusting means is provided for actuating the adjusting means to urge the second clamping section of the movable jaw to move slightly away from the first clamping section of the fixed jaw. A retaining means is provided for retaining the fine adjusting means in position.

In a preferred embodiment of the invention, the adjusting means includes a screw rod having a first end and a second end. The screw rod includes a wheel formed on a mediate section thereof, and the movable jaw includes a first pin mounted therein. The first pin has a first transverse screw hole through which the first end of the screw rod extends. The engaging section includes a second pin mounted therein, and the second pin includes a second transverse screw hole through which the second end of the screw rod extends. The wheel includes a plurality of alternatively disposed longitudinal ribs and longitudinal grooves.

The fine adjusting means includes a hollow cylindrical member and a catch member. The hollow cylindrical member includes an eccentric longitudinal hole for receiving the second pin and a periphery, and the catch member includes a first end secured to the periphery of the hollow cylindrical member to move therewith and a second end for releasably engaging with the wheel.

The periphery of the hollow cylindrical member includes a first arcuate slot defined therein and a second arcuate slot defined therein and spaced from the first arcuate slot. Each of the first arcuate slot and the second arcuate slot includes a first end edge and a second end edge. The first end of the catch member includes an engaging surface having two hooked portions respectively formed on two ends thereof for securely engaging with the first end edges respectively of the first arcuate slot and the second arcuate slot.

The engaging section of the elongated member includes a pair of spaced lugs having aligned holes defined therein for receiving the second pin. The second end of the elongated member includes a compartment defined therein and communicated with a space between the spaced lugs. The retaining means includes a ball and a spring received in the compartment. The spring biases the ball to engage with one of the second end edges respectively of the first arcuate slot and the second arcuate slot, wherein the ball engages the second end edge of the second arcuate slot before fine adjustment of the movable jaw, and wherein the ball engages with the second end edge of the first arcuate slot after fine adjustment of the movable jaw.

The second end of the movable jaw includes a pair of spaced wall members. The wall members include first aligned holes defined in a first section thereof for receiving a third pin and second aligned holes defined in a second section thereof for receiving the first pin. A recessed section is formed between the fixed jaw and the engaging section, wherein the recessed section includes a through hole through which the third pin extends.

Other objects, advantages, and novel features of the invention will become more apparent from the following detailed description when taken in conjunction with the accompanying drawings.

DESCRIPTION OF THE PREFERRED EMBODIMENT

Figure 1:
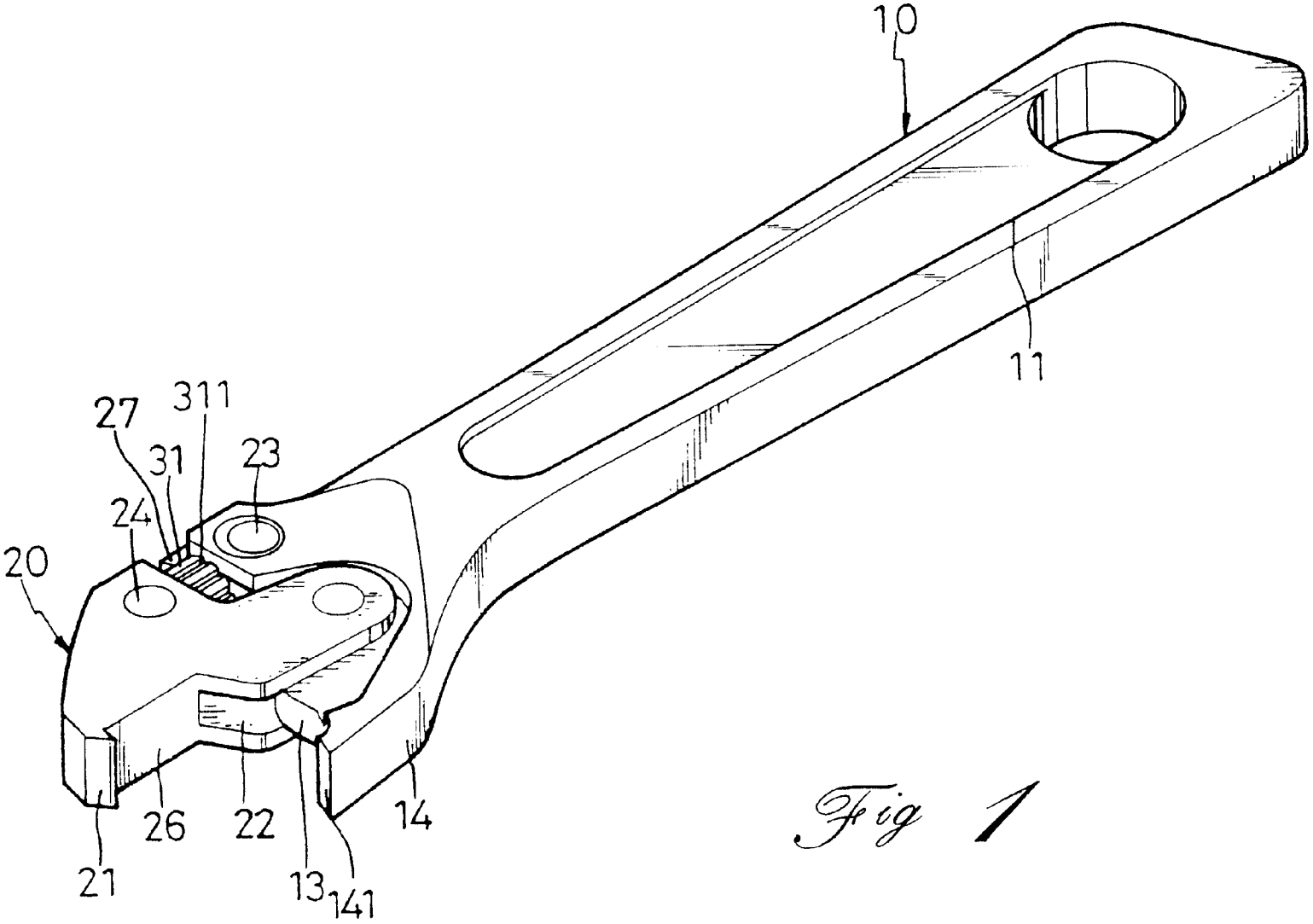
FIG. 1 is a perspective view of an adjustable wrench in accordance with the present invention.
Figure 2:
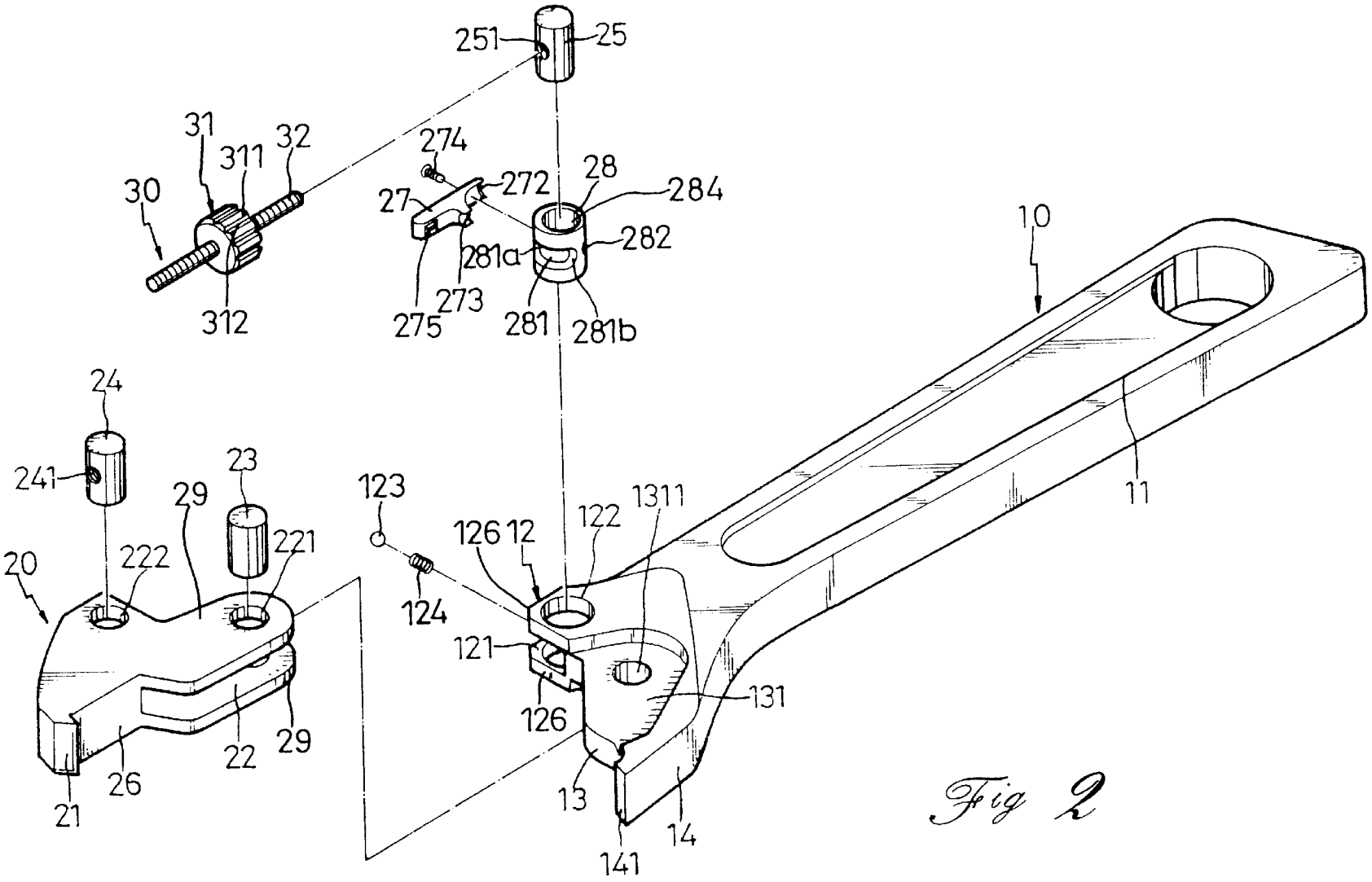
FIG. 2 is an exploded perspective view of the adjustable wrench in accordance with the present invention.

Referring to the drawings and initially to FIGS. 1 and 2, an adjustable wrench in accordance with the present invention generally includes an elongated member 10 having a first handle end 11 and a second end on which a fixed jaw 14 is formed. The fixed jaw 14 includes a first clamping section 14 which will be described later. Also formed on the second end of the elongated member 10 is an engaging section 12 having a pair of lugs 126 formed thereon. The lugs 126 include a space 121 defined therebetween and aligned holes 122 defined therein. A recessed section 13 is formed between the engaging section 12 and the fixed jaw 14. The recessed section includes a recess 131 defined in each of two sides thereof and thus have a thickness smaller than that of the elongated member 10. The recessed section 13 further includes a hole 1311 defined therein.

The adjustable wrench further includes a movable jaw 20 having a first end on which a second clamping section 21 is formed. The movable jaw 20 further includes a second end including a pair of spaced wall members 29 which, in turn, define a space 22 therebetween. The wall members 29 include aligned holes 221 defined in a first section thereof for receiving a pin 23 therein and aligned holes 222 defined in a second section thereof for receiving a pin 24 having a transverse screw hole 241 therein. The movable jaw 20 further includes an engaging face 26 defined adjacent to the second clamping section 21 to provide a close contact with the fastener to be tightened or loosened.

The adjustable wrench further includes an adjusting means 30, which, in turn, includes a screw rod 32 with a wheel 31 integrally formed on a mediate section thereof. The wheel 31 includes a plurality of alternately disposed longitudinal ribs 311 and grooves 312. The adjustable wrench further includes a spring 124 and a ball 123 which are received in a compartment 125 (FIG. 3) defined in the second end of the elongated member 10 and communicated with the space 121 between the lugs 126.

A hollow cylindrical member 28 is pivotally received in the aligned holes 122 and includes an eccentric longitudinal hole 284 (FIG. 1) defined therein for pivotally receiving a pin 25 having a transverse screw hole 251. The hollow cylindrical member 28 includes two spaced arcuate slots 281, 282 defined in a periphery thereof, each arcuate slot 281, 282 having two end edges 281*a*, 281*b*; 282*a*, 282*b*, respectively. In addition, referring to FIG. 3, a catch member 27 is secured to the hollow cylindrical member 28 by a screw 274. The catch member 27 includes a first end having an engaging surface 271 formed thereon and a second end having an engaging tooth 275 formed thereon. The engaging surface 271 includes two hooked portions 272, 273 respectively formed on two ends thereof such that the catch member 27 can be securely attached to the end edges 281*a* and 282*a* respectively of the arcuate slots 281 and 282, best shown in FIG. 3.

Figure 3:
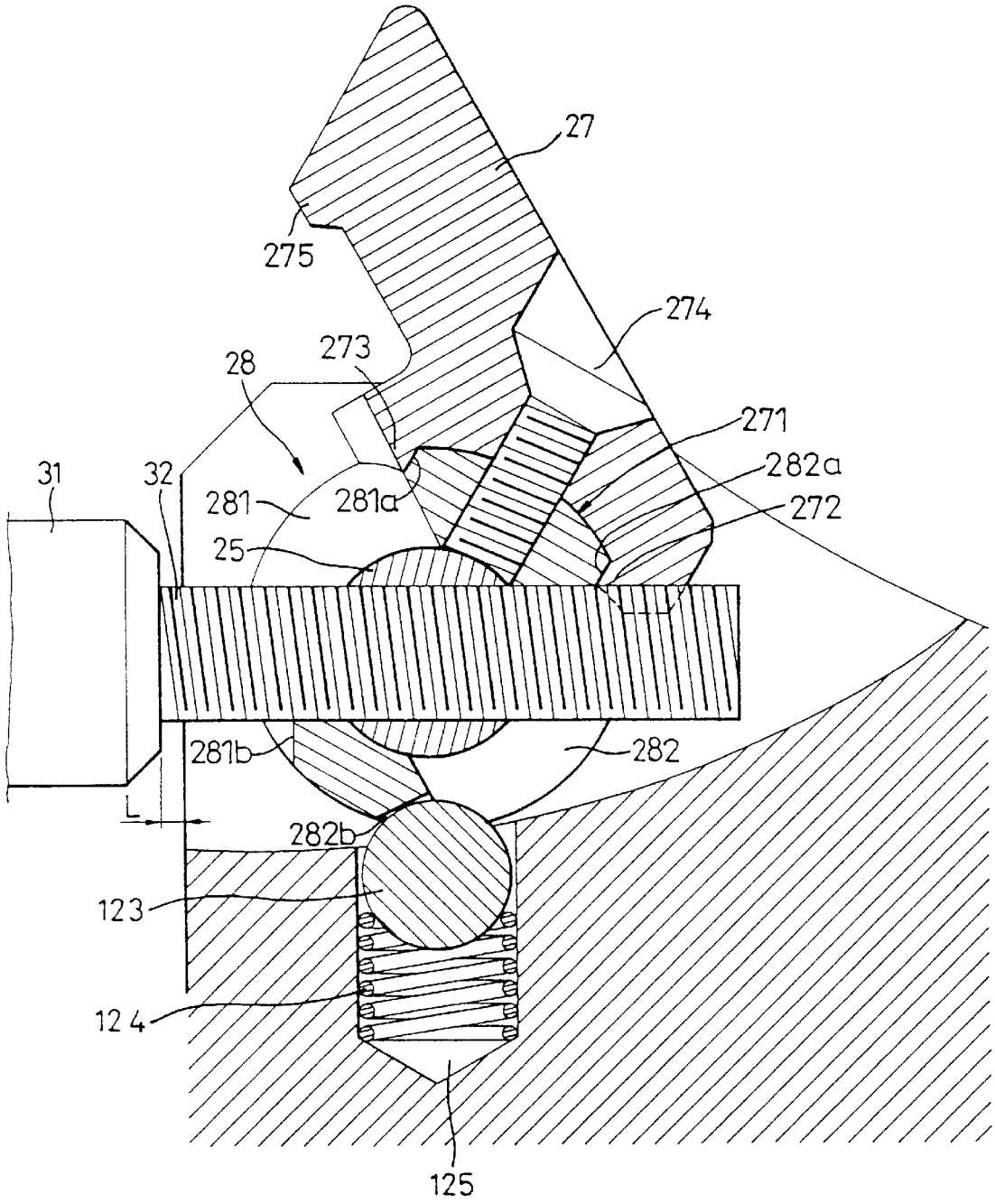
FIGS. 3 and 4 are enlarged fragmentary sectional views showing fine adjustment of the adjustable wrench in accordance with the present invention.

In assembly, still referring to FIGS. 1 to 3, the pin 25 is inserted into the hollow cylindrical member 28 which, in turn, is inserted into the aligned holes 122. The catch member 27 is then secured to the hollow cylindrical member 28 in which the two hooked ends 272 and 273 of the first end of the catch member 27 is engaged with the end edges 281*a* and 282 respectively of the arcuate slots 281 and 282 to move therewith, best shown in FIG. 3. The, two ends of the screw rod 31 are respectively threadedly engaged with transverse screw holes 251 and 241 defined in the pins 25 and 24, respectively.

Thereafter, the holes 221 of the movable jaw 20 are aligned with the hole 1311 of the recessed section 13, and the pin 23 is inserted into the holes 221 and 1311, thereby allowing pivotal movement of the movable jaw 20 relative to the fixed jaw 14. It is appreciated that the recessed section 13 is received in the space 22 of the movable jaw 20, and the wall members 29 are respectively located on both sides of the recessed section 13. As shown in FIG. 3, the spring 124 biases the ball 123 to engage with one of the end edges 281*b* and 282*b*, which will be described later.

Figure 5:
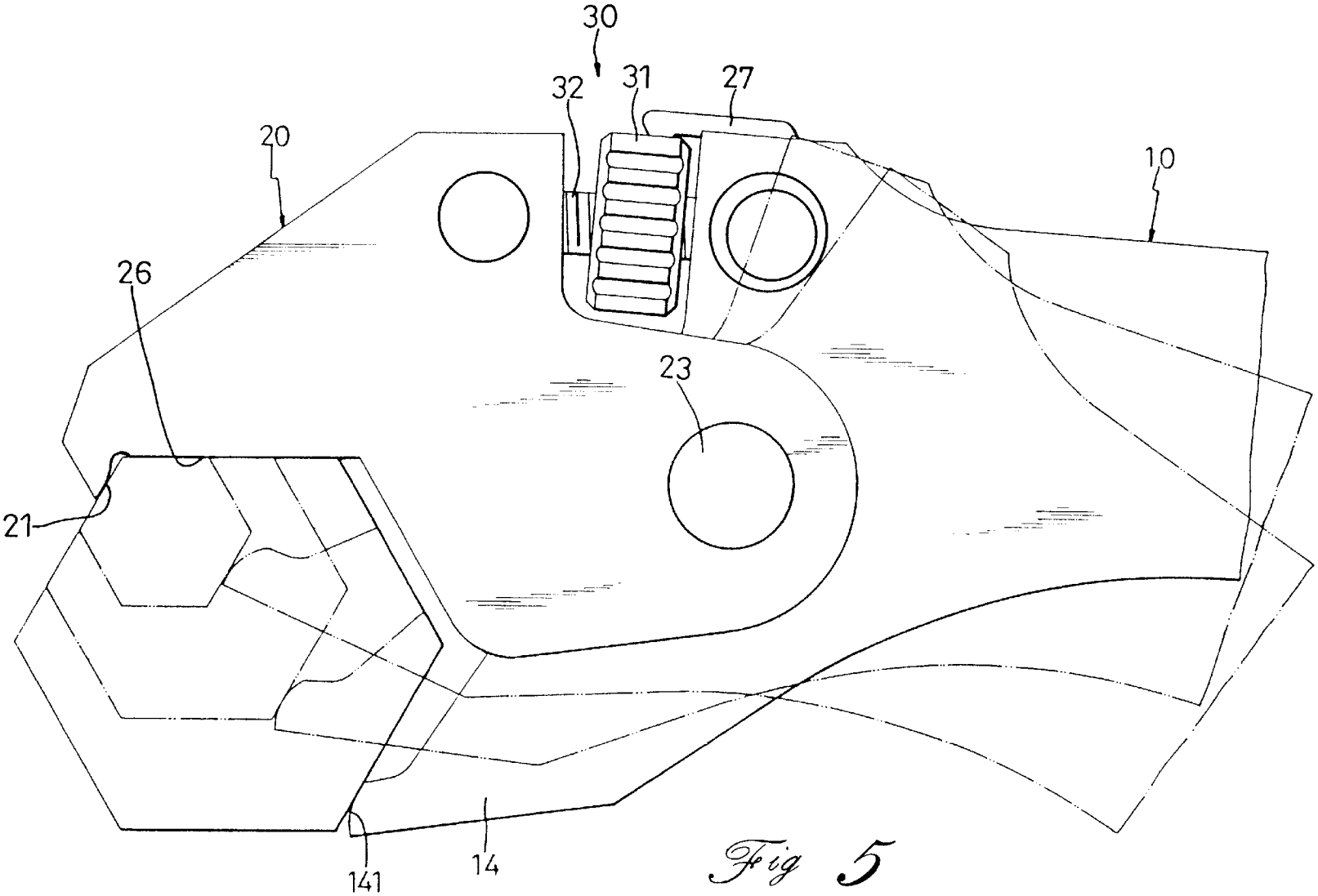
FIG. 5 is a schematic view illustrating application of the adjustable wrench in accordance with the present invention.

FIG. 5 illustrates application of the adjustable wrench of the present invention to clamp fasteners of various sizes, wherein the required adjustment thereof is to merely rotate the wheel 31 which causes movement of the pins 25 and 24 to thereby urge the movable jaw 20 to move relative to the fixed jaw 14 to securely hold the fastener with the engaging face 26 as well as the clamping sections 21 and 141.

Figure 4:
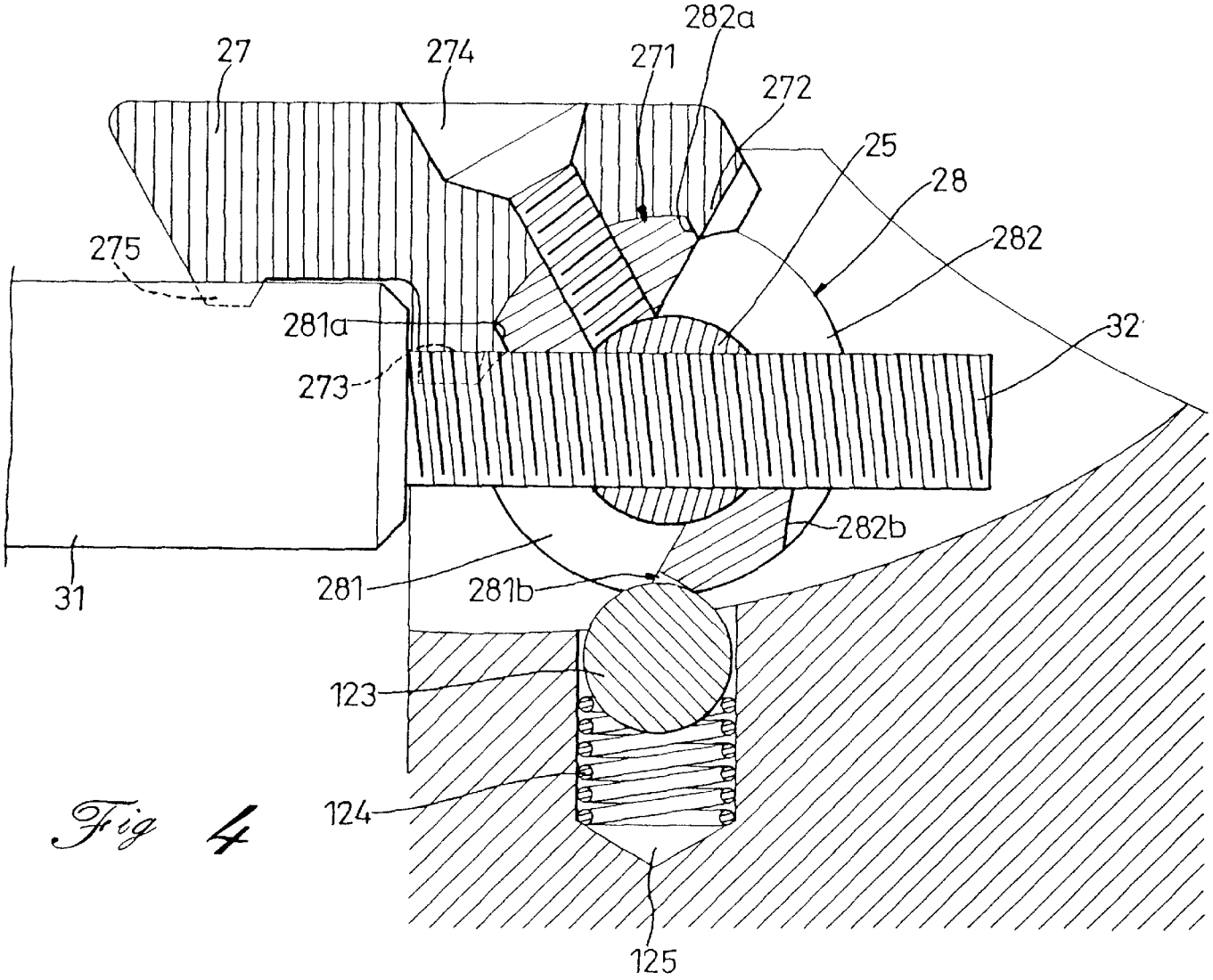

When in use, before tightly clamping the fastener, e.g., a bolt (FIG. 5), the catch member 27 is pushed upwardly to a status shown in FIG. 3, and the ball 123 engages with the end edge 282*b* of the arcuate slot 282. The user may adjust position of the movable jaw 20 to tightly clamp the fastener (FIG. 5). As the pin 25 is received in the eccentric hole 284 of the hollow cylindrical member 28, a gap "L" (FIG. 3) is generated between the wheel 31 and the engaging section 12. However, it is noted that the fastener cannot be speedily rotated for tightening or loosening under this status without further fine adjustment. At this time, the user may press the second end of the catch member 27 toward the wheel 31 to a status shown in FIG. 4, wherein the engaging tooth 275 securely engages with the wheel 31. The ball 123 disengages from the end edge 282*b* , slides through the periphery of the hollow cylindrical member 28, and then engages with another end edge 281*b*. As a result, the hollow cylindrical member 28 carries the screw rod 32 to the left such that the gap "L" between the wheel 31 and the engaging section 12 is shortened or even disappears, meanwhile, the movable jaw 20 is slightly moved away from the fastener such that a tolerance clearance therebetween is adjusted allow speedy rotation of the fastener for tightening or loosening. More specifically, the catch member 27 and the cylindrical member 28 act as a fine adjusting means for actuating the adjusting means 30 to urge the second clamping section 21 of the movable jaw 20 to move slightly away from the first clamping section 141 of the fixed jaw 14. It is appreciated that the spring 124 and the ball 123 provide a positioning effect for the movable jaw 20 to securely clamp the fastener after the fine adjustment is completed.

According to the above description, it is appreciated that the adjustable wrench in accordance with the present invention may speedily clamp fasteners of different sizes, and after ordinary speedy adjustment of the distance between the clamping sections 141 and 21, the catch member 27 is pressed to accomplish the fine adjustment which provides a positioning effect between the fastener and the adjustable wrench under the action of the spring 124 and the ball 123 and which allows speedy tightening or loosening of the fastener (i.e., the user does not have to slowly adjust the clearance for speedily rotating the fastener).

Although the invention has been explained in relation to its preferred embodiment, it is to be understood that many other possible modifications and variations can be made without departing from the spirit and scope of the invention as hereinafter claimed.

What is claimed is:

1. An adjustable wrench, comprising:

an elongated member including a first handle end and a second end, the second end including a fixed jaw and an engaging section formed thereon, the fixed jaw having a first clamping section, a movable jaw having a second clamping section formed on a first end thereof and a second end pivotally connected to the engaging section of the elongated member, an adjusting means mounted between the second end of the elongated member and the movable jaw to urge the movable jaw to pivot relative to the fixed jaw, a fine adjusting means for actuating the adjusting means to urge the second clamping section of the movable jaw to move slightly away from the first clamping section of the fixed jaw, and a retaining means for retaining the fine adjusting means in position.

2. The adjustable wrench according to claim 1, wherein the adjusting means includes a screw rod having a first end and a second end, the screw rod includes a wheel formed on a mediate section thereof, the movable jaw includes a first pin mounted therein, the first pin has a first transverse screw hole through which the first end of the screw rod extends, and the engaging section includes a second pin mounted therein, the second pin includes a second transverse screw hole through which the second end of the screw rod extends.

3. The adjustable wrench according to claim 2, wherein the wheel includes a plurality of alternatively disposed longitudinal ribs and longitudinal grooves.

4. The adjustable wrench according to claim 3, wherein the fine adjusting means includes a hollow cylindrical member and a catch member, the hollow cylindrical member includes an eccentric longitudinal hole for receiving the second pin and a periphery, the catch member includes a first end secured to the periphery of the hollow cylindrical member to move therewith and a second end for releasably engaging with the wheel.

5. The adjusting wrench according to claim 4, wherein the periphery of the hollow cylindrical member includes a first arcuate slot defined therein and a second arcuate slot defined therein and spaced from the first arcuate slot, each of said first arcuate slot and said second arcuate slot includes a first end edge and a second end edge, and the first end of the catch member includes an engaging surface having two hooked portions respectively formed on two ends thereof for securely engaging with the first end edges respectively of the first arcuate slot and the second arcuate slot.

6. The adjustable wrench according to claim 5, wherein the engaging section of the elongated member includes a pair of spaced lugs having aligned holes defined therein for receiving the second pin, the spaced lugs includes a space defined therebetween.

7. The adjustable wrench according to claim 6, wherein the second end of the elongated member includes a compartment defined therein and communicated with the space between the spaced lugs, and the retaining means includes a ball and a spring received in the compartment, the spring biases the ball to engage with one of the second end edges respectively of the first arcuate slot and the second arcuate slot.

8. The adjustable wrench according to claim 7, wherein the ball engages the second end edge of the second arcuate slot before fine adjustment of the movable jaw.

9. The adjustable wrench according to claim 7, wherein the ball engages with the second end edge of the first arcuate slot after fine adjustment of the movable jaw.

10. The adjustable wrench according to claim 4, wherein the second end of the movable jaw includes a pair of spaced wall members, the wall members include first aligned holes defined in a first section thereof for receiving a third pin and second aligned holes defined in a second section thereof for receiving the first pin, and a recessed section is formed between the fixed jaw and the engaging section, wherein the recessed section includes a through hole through which the third pin extends.

* * * * *